US011205549B1

(12) United States Patent
Chen et al.

(10) Patent No.: US 11,205,549 B1
(45) Date of Patent: Dec. 21, 2021

(54) KEYCAP STRUCTURE

(71) Applicant: Primax Electronics Ltd., Taipei (TW)

(72) Inventors: Bo-An Chen, Taipei (TW); Chin-Sung Pan, Taipei (TW); Ya-Chin Tu, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 0 days.

(21) Appl. No.: 17/165,631

(22) Filed: Feb. 2, 2021

(30) Foreign Application Priority Data

Dec. 8, 2020 (TW) ..... 109143298

(51) Int. Cl.
*H01H 13/83* (2006.01)

(52) U.S. Cl.
CPC ..... *H01H 13/83* (2013.01); *H01H 2219/028* (2013.01); *H01H 2219/036* (2013.01)

(58) Field of Classification Search
CPC ..... H01H 13/83; H01H 9/18; H01H 9/181; H01H 9/182; H01H 2219/028; H01H 2219/014
USPC ..... 200/5 A, 310–314, 317
See application file for complete search history.

(56) References Cited

U.S. PATENT DOCUMENTS

2015/0200062 A1* 7/2015 Ura ..... H01H 13/023 200/314
2016/0042890 A1* 2/2016 Lin ..... H01H 13/83 200/5 A

* cited by examiner

*Primary Examiner* — Edwin A. Leon
*Assistant Examiner* — Iman Malakooti
(74) *Attorney, Agent, or Firm* — Kirton McConkie; Evan R. Witt

(57) ABSTRACT

A keycap structure includes a keycap body and a display module. The keycap body includes a top wall and a lateral wall. The lateral wall is extended downwardly from a periphery region of the top wall. An accommodation space is defined by the top wall and the lateral wall collaboratively. The display module is disposed within the accommodation space. The display module includes a light-transmissible circuit substrate and plural light-emitting elements. The plural light-emitting elements are installed on the light-transmissible circuit substrate and electrically connected with the light-transmissible circuit substrate. After the light beams are transmitted through the light-transmissible circuit substrate and the top wall sequentially, the light beams are outputted from the keycap body. The light beams from the plural light-emitting elements are collaboratively formed as a luminous zone. Moreover, a pattern corresponding to the luminous zone is shown on the display module.

11 Claims, 3 Drawing Sheets

KEYCAP STRUCTURE

FIELD OF THE INVENTION

The present invention relates to an input device, and more particularly to a keycap structure.

BACKGROUND OF THE INVENTION

With increasing development of science and technology, a variety of electronic devices are designed in views of convenience and user-friendliness. For helping the user well operate the electronic devices, the electronic devices are gradually developed in views of humanization. The input devices of the common electronic devices include for example mouse devices, keyboard devices, trackball devices, or the like. Via the keyboard device, texts or symbols can be inputted into the computer system directly. As a consequence, most users and most manufacturers of input devices pay much attention to the development of keyboard devices.

Generally, a conventional keyboard device comprises plural keys. These keys have symbols thereon to indicate different letters and numbers. However, the patterns (e.g., texts or symbols) on the keycaps of the general keyboard device are usually directly printed on the keycaps, and the keycap is usually to have a square four-corner profile and a plastic front surface. Consequently, the whole keycap can only present a monotonous color such as a black color or another single color. Even if a backlight module is located under the keycap to emit a light beam to the keycap, the pattern can be illuminated to produce a monochromatic luminous effect only. Since the keycap usually has no design sense and variability, the competitiveness of the product on the market cannot be improved.

For solving the above drawbacks, some keyboard devices with new designs have been introduced into the market. For example, in a conventional keyboard device, a display module is installed in the keycap of the key. The pattern shown on the display module can be directly displayed on the keycap of the key. Moreover, the personalized symbols, patterns and colors shown on the display module can be controlled by the user according to the practical requirements. However, this design still has some problems. For example, when the keyboard device is used for performing a typing input action, the user's finger directly applies a force to the keycap of the key. Since the keycap is frequently clicked, the display module installed in the keycap is suffered from the impact. The impact will cause damage to the light-emitting elements of the display module.

Therefore, there is a need of providing an improved keycap structure in order to overcome the drawbacks of the conventional technologies.

SUMMARY OF THE INVENTION

An object of the present invention provides a keycap structure with a display module. The display module has high pressure resistance. Consequently, the capability of the display module to withstand the pressure of the user's finger will be effectively enhanced.

The other objects and advantages of the present invention will be understood from the disclosed technical features.

In accordance with an aspect of the present invention, a keycap structure is provided. The keycap structure includes a keycap body and a display module. The keycap body includes a top wall and a lateral wall. The lateral wall is extended downwardly from a periphery region of the top wall. An accommodation space is defined by the top wall and the lateral wall collaboratively. The display module is disposed within the accommodation space of the keycap body. The display module includes a light-transmissible circuit substrate and plural light-emitting elements. The light-transmissible circuit substrate has a top surface and a bottom surface opposed to the top surface. The top surface of the light-transmissible circuit substrate is located near the top wall of the keycap body. The bottom surface of the light-transmissible circuit substrate is located away from the top wall of the keycap body. The plural light-emitting elements are installed on the bottom surface of the light-transmissible circuit substrate and electrically connected with the light-transmissible circuit substrate. The plural light-emitting elements emit light beams. After the light beams are transmitted through the bottom surface, the top surface and the top wall sequentially, the light beams are outputted from the keycap body. The light beams from the plural light-emitting elements are collaboratively formed as a luminous zone. Moreover, a pattern corresponding to the luminous zone is shown on the display module.

In an embodiment, the top wall of the keycap body includes a hollow region and a glass plate, and the glass plate is installed within the hollow region. After the light beams from the plural light-emitting elements are transmitted through the bottom surface, the top surface and the glass plate of the top wall sequentially, the light beams are outputted from the keycap body.

In an embodiment, the top wall of the keycap body includes a hollow region. After the light beams from the plural light-emitting elements are transmitted through the bottom surface, the top surface and the hollow region of the top wall sequentially, the light beams are outputted from the keycap body.

In an embodiment, the keycap body is made of a translucent material or a transparent material.

In an embodiment, the display module further includes a protective layer. The plural light-emitting elements and the bottom surface of the light-transmissible circuit substrate are covered by the protective layer. The plural light-emitting elements are arranged between the light-transmissible circuit substrate and the protective layer.

In an embodiment, the keycap structure further includes a supporting pedestal, and the supporting pedestal is disposed within the accommodation space of the keycap body. The display module is arranged between the top wall of the keycap body and the supporting pedestal. The supporting pedestal has a first surface and a second surface opposed to the first surface. The protective layer of the display module is contacted with the first surface of the supporting pedestal.

In an embodiment, the keycap structure further includes at least one coupling element, and the at least one coupling element is installed on the second surface of the supporting pedestal. The at least one coupling element is connected with an ascending/descending member.

In an embodiment, the at least one coupling element is integrally formed with the supporting pedestal.

In an embodiment, the keycap structure further includes a flexible circuit board, wherein the flexible circuit board is electrically connected to the light-transmissible circuit substrate, and the light-transmissible circuit substrate is electrically connected with an external driving control circuit board through the flexible circuit board.

In an embodiment, the plural light-emitting elements are micro light-emitting diodes.

In accordance with another aspect of the present invention, a keycap structure is provided. The keycap structure includes a keycap body and a display module. The keycap body includes a top wall and a lateral wall. The lateral wall is extended downwardly from a periphery region of the top wall. An accommodation space is defined by the top wall and the lateral wall collaboratively, and the top wall includes a hollow region. The display module is disposed within the hollow region of the top wall. The display module includes a light-transmissible circuit substrate and plural light-emitting elements. The light-transmissible circuit substrate has a top surface and a bottom surface opposed to the top surface. The top surface of the light-transmissible circuit substrate is exposed outside the top wall of the keycap body. The bottom surface of the light-transmissible circuit substrate faces the accommodation space of the keycap body. The plural light-emitting elements are installed on the bottom surface of the light-transmissible circuit substrate and electrically connected with the light-transmissible circuit substrate. The plural light-emitting elements emit light beams. After the light beams are transmitted through the bottom surface and the top surface sequentially, the light beams are outputted from the keycap body. The light beams from the plural light-emitting elements are collaboratively formed as a luminous zone. In addition, a pattern corresponding to the luminous zone is shown on the display module.

From the above descriptions, the present invention provides the keycap structure. The plural light-emitting elements of the display module are installed on the bottom surface of the light-transmissible circuit substrate. The bottom surface of the light-transmissible circuit substrate is located away from the top wall of the keycap body. The protective layer is located under the plural light-emitting elements to cover the plural light-emitting elements. Due to this structural design, the following benefits are achieved. While the keycap structure is pressed down by the user's finger, the pressing force on the display module is blocked by the light-transmissible circuit substrate and the protective layer. Since the light-emitting elements are not suffered from the direct impact by the pressing force, the possibility of causing damage of the light-emitting elements will be minimized and the capability of the display module to withstand the pressure of the user's finger will be effectively enhanced. Moreover, since these light-emitting elements are installed between the bottom surface of the light-transmissible circuit substrate and the protective layer, the moisture is blocked by the light-transmissible circuit substrate and the protective layer. Since the moisture does not readily enter the light-emitting elements, the possibility of causing the damage of the light-emitting elements by moisture will be minimized. When the keycap structure of the present invention is applied to various key structures, the light intensities, the light colors and the luminous zone changes of the display module can be adjusted according to the user's requirements. Consequently, the pattern shown on the keycap body can be designed by the user. Moreover, since the light-emitting elements of the display module are micro light-emitting diodes, the appearance of the key structure can meet the requirements of slimness and light weightiness.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
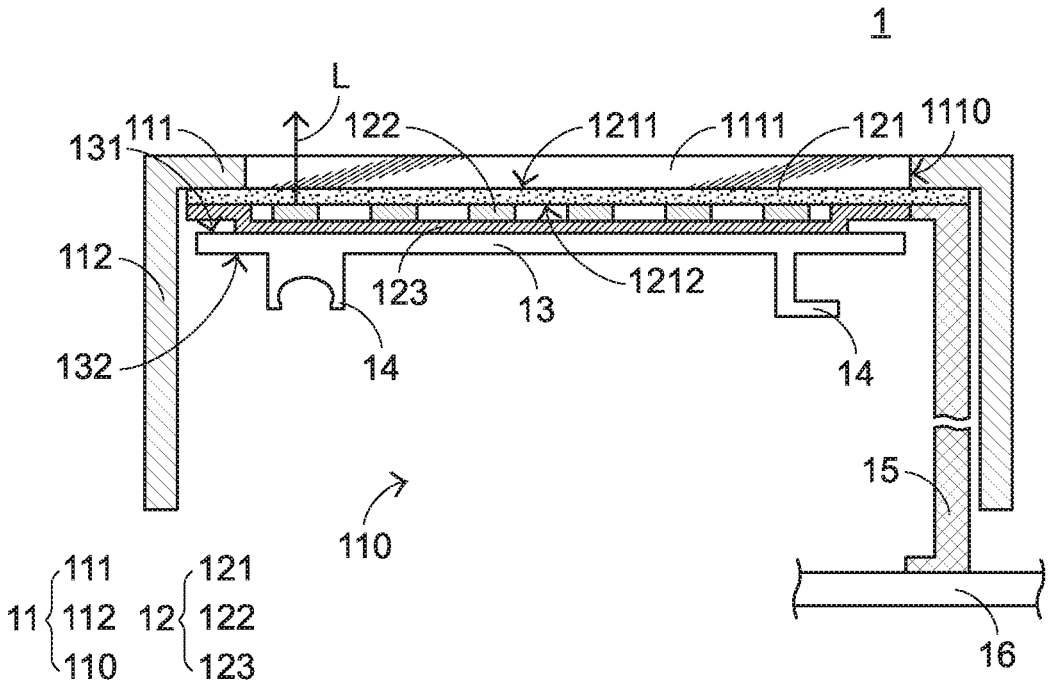
FIG. 1 is a schematic cross-sectional view illustrating a keycap structure according to a first embodiment of the present invention.
Figure 2:
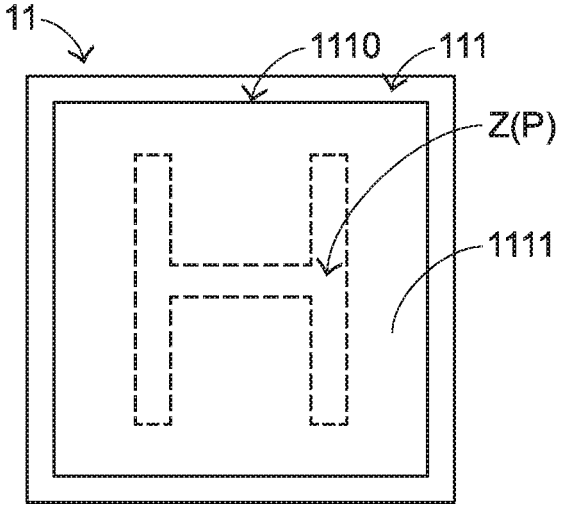
FIG. 2 is a schematic top view illustrating the keycap structure as shown in FIG. 1.

Please refer to FIGS. 1 and 2. FIG. 1 is a schematic cross-sectional view illustrating a keycap structure according to a first embodiment of the present invention. FIG. 2 is a schematic top view illustrating the keycap structure as shown in FIG. 1. As shown in FIGS. 1 and 2, the keycap structure 1 comprises a keycap body 11 and a display module 12.

The keycap body 11 comprises a top wall 111 and a lateral wall 112. The lateral wall 112 is extended downwardly from the periphery region of the top wall 111. In addition, an accommodation space 110 is defined by the top wall 111 and the lateral wall 112 collaboratively.

The display module 12 is disposed within the accommodation space 110 of the keycap body 11. The display module 12 comprises a light-transmissible circuit substrate 121 and plural light-emitting elements 122. The light-transmissible circuit substrate 121 has a top surface 1211 and a bottom surface 1212, which are opposed to each other. The top surface 1211 of the light-transmissible circuit substrate 121 is located near the top wall 111 of the keycap body 11. The bottom surface 1212 of the light-transmissible circuit substrate 121 is located away from the top wall 111 of the keycap body 11. The plural light-emitting elements 122 are installed on the bottom surface 1212 of the light-transmissible circuit substrate 121 and electrically connected with the light-transmissible circuit substrate 121. The plural light-emitting elements 122 emit light beams L. After the light beams L are transmitted through the bottom surface 1212 of the light-transmissible circuit substrate 121, the top surface 1211 of the light-transmissible circuit substrate 121 and the top wall 111 of the keycap body 11 sequentially, the light beams L are outputted from the keycap body 11. Moreover, the light beams L from the light-emitting elements 122 are collaboratively formed as a luminous zone Z. Consequently, a pattern corresponding to the luminous zone Z is shown on the display module 12.

Preferably but not exclusively, the plural light-emitting elements 122 are micro light-emitting diodes. The plural light-emitting elements 122 are electrically connected with the light-transmissible circuit substrate 121. The light-transmissible circuit substrate 121 can control the circuitry operations of the plural light-emitting elements 122. That is, when the light-emitting element 122 acquires electricity, the light-emitting element 122 is enabled to emit the light beam L. Preferably but not exclusively, the top surface 1211 of the light-transmissible circuit substrate 121 is directly attached on the top wall 111 of the keycap body 11.

The keycap structure 1 will be described in more details as follows.

Please refer to FIG. 1 again. The top wall 111 of the keycap body 11 comprises a hollow region 1110 and a glass plate 1111. The glass plate 1111 is installed within the hollow region 1110. Preferably but not exclusively, the top surface of the glass plate 1111 and the top surface of the top wall 111 are coplanar with each other, and the bottom surface of the glass plate 1111 and the bottom surface of the top wall 111 are coplanar with each other. Especially, after the light beams L from the light-emitting elements 122 of the display module 12 are transmitted through the bottom surface 1212 of the light-transmissible circuit substrate 121, the top surface 1211 of the light-transmissible circuit substrate 121 and the glass plate 1111 of the top wall 111 of the keycap body 11 sequentially, the light beams L are outputted from the keycap body 11.

Please refer to FIG. 1 again. The display module 12 further comprises a protective layer 123. The protective layer 123 is used for covering the plural light-emitting elements 122 and the bottom surface 1212 of the light-transmissible circuit substrate 121. In addition, the plural light-emitting elements 122 are arranged between the light-transmissible circuit substrate 121 and the protective layer 123. In this embodiment, the protective layer 123 is a single coating layer that is formed under the plural light-emitting elements 122 and the light-transmissible circuit substrate 121. It is noted that numerous modifications and alterations may be made while retaining the teachings of the invention. For example, in another embodiment, the protective layer 123 is located under each light-emitting element 122.

Please refer to FIG. 1 again. The keycap structure 1 further comprises a supporting pedestal 13. The supporting pedestal 13 is disposed within the accommodation space 110 of the keycap body 11. The display module 12 is arranged between the top wall 111 of the keycap body 11 and the supporting pedestal 13. The supporting pedestal 13 has a first surface 131 and a second surface 132, which are opposed to each other. The protective layer 123 of the display module 12 is contacted with the first surface 131 of the supporting pedestal 13. As mentioned above, the plural light-emitting elements 122 and the bottom surface 1212 of the light-transmissible circuit substrate 121 are covered by the protective layer 123. Due to the arrangement of the protective layer 123, the plural light-emitting elements 122 of the display module 12 are not directly connected with other components. In this embodiment, the protective layer 123 is further served as a barrier layer between the plural light-emitting elements 122 and the supporting pedestal 13. Generally, while the keycap structure 1 is pressed down or restored upwardly, an action force is generated. Due to the arrangement of the protective layer 123, the action force generated when the keycap structure 1 is restored upwardly will not directly impact on the light-emitting elements 122 through the supporting pedestal 13.

Please refer to FIG. 1 again. The keycap structure 1 further comprises at least one coupling element 14. In this embodiment, the keycap structure 1 comprises plural coupling elements 14. It is noted that the number of the coupling elements 14 is not restricted. The coupling elements 14 are installed on the second surface 132 of the supporting pedestal 13. These coupling elements 14 are connected with an ascending/descending member of the keycap structure 1. In case that the keycap structure 1 is applied to the key structure a general keyboard device, the ascending/descending member connected with the coupling elements 14 of the keycap structure 1 is a scissors-type connecting member. Whereas, in case that the keycap structure 1 is applied to the key structure a mechanical keyboard device, the ascending/descending member connected with the coupling elements 14 of the keycap structure 1 is a mechanical keyswitch member. It is noted that the applications of the keycap structure 1 are not restricted to the above key structures. That is, the keycap structure 1 can be applied to any other appropriate key structure. In an embodiment, these coupling elements 14 are integrally formed with the supporting pedestal 13. It is noted that numerous modifications and alterations may be made while retaining the teachings of the invention. For example, in another embodiment, the coupling elements 14 and the supporting pedestal 13 are separate components.

Please refer to FIG. 1 again. The keycap structure 1 further comprises a flexible circuit board 15. The flexible circuit board 15 is electrically connected to the light-transmissible circuit substrate 121 of the display module 12. The light-transmissible circuit substrate 121 is electrically connected with an external driving control circuit board 16 through the flexible circuit board 15. The driving control circuit board 16 is installed within the keyboard device for processing electronic signals associated with various electronic functions of the keyboard device. That is, when the flexible circuit board 15 of the keycap structure 1 is electrically connected with the driving control circuit board 16, the driving control circuit board 16 can be used to drive and control the light-emitting elements 122 of the display module 12. Consequently, the light intensities, the light colors and the luminous zone changes are adjustable. In this way, the pattern shown on the keycap body 11 can be designed by the user.

As mentioned above, the light-emitting elements 122 of the display module 12 are installed on the bottom surface 1212 of the light-transmissible circuit substrate 121. The bottom surface 1212 of the light-transmissible circuit substrate 121 is located away from the top wall 111 of the keycap body 11. In addition, the protective layer 123 is located under the light-emitting elements 122 to cover the light-emitting elements 122. Due to this structural design, the following benefits are achieved. While the keycap structure 1 is pressed down, the use of the light-transmissible circuit substrate 121 can prevent the generated action force from directly impacting on the light-emitting elements 122. While the keycap structure 1 is restored upwardly, the use of the protective layer 123 can prevent the generated action force from directly impacting on the light-emitting elements 122 through the supporting pedestal 13. Consequently, the capability of the display module 12 to withstand the pressure of the user's finger will be effectively enhanced. Moreover, since these light-emitting elements 122 are installed between the bottom surface 1212 of the light-transmissible circuit substrate 121 and the protective layer 123, the moisture is blocked by the light-transmissible circuit substrate 121 and the protective layer 123. Since the moisture does not readily enter the light-emitting elements 122, the possibility of causing the damage of the light-emitting elements 122 by moisture is minimized.

Figure 3:
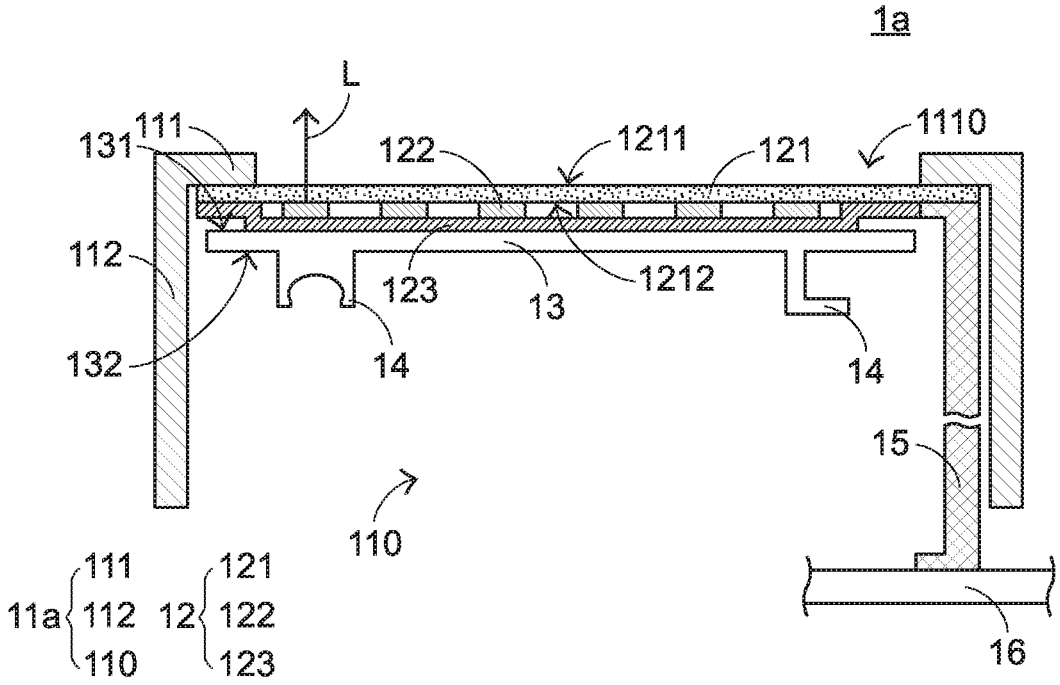
FIG. 3 is a schematic cross-sectional view illustrating a keycap structure according to a second embodiment of the present invention.

FIG. 3 is a schematic cross-sectional view illustrating a keycap structure according to a second embodiment of the present invention. In comparison with the keycap structure 1 of FIG. 1, the top wall 111 of the keycap structure 1*a* in this embodiment is distinguished. In this embodiment, the top wall 111 of the keycap structure 1*a* comprises the hollow region 1110 only. In contrast, the glass plate 1111 in the hollow region 1110 as shown in FIG. 1 is omitted. After the light beams L from the light-emitting elements 122 of the display module 12 are transmitted through the bottom surface 1212 of the light-transmissible circuit substrate 121, the top surface 1211 of the light-transmissible circuit substrate 121 and the hollow region 1110 of the top wall 111 of the keycap body 11*a* sequentially, the light beams L are outputted from the keycap body 11*a*.

Figure 4:
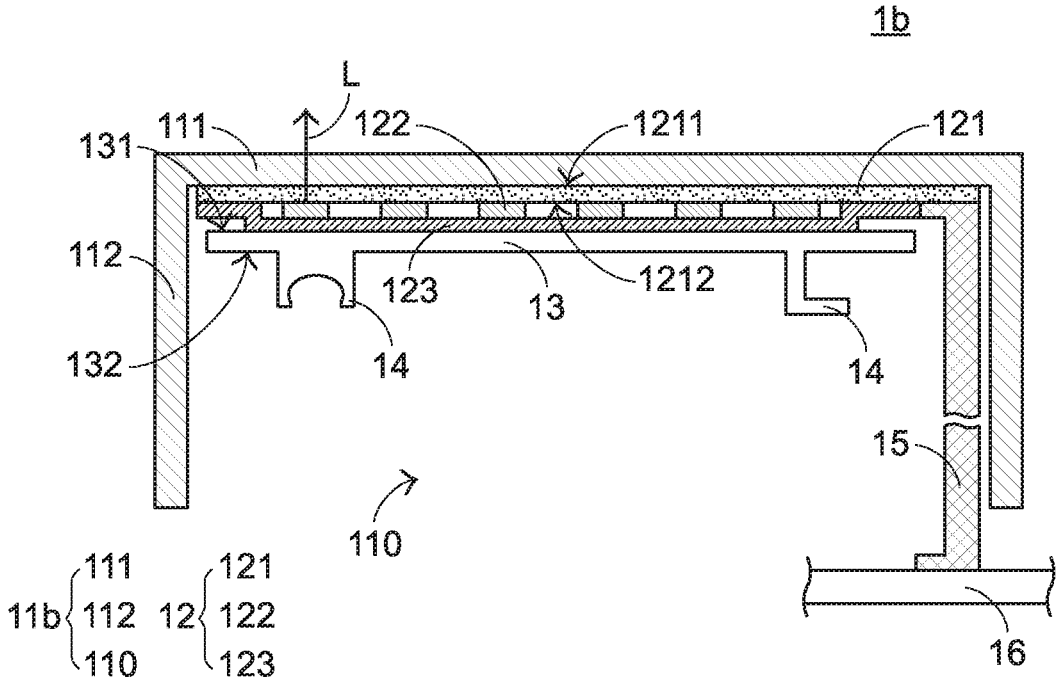
FIG. 4 is a schematic cross-sectional view illustrating a keycap structure according to a third embodiment of the present invention.

FIG. 4 is a schematic cross-sectional view illustrating a keycap structure according to a third embodiment of the present invention. In comparison with the keycap structure 1 of FIG. 1, the material of the keycap body 11*b* of the keycap structure 1*b* in this embodiment is distinguished. In the keycap structure 1*b*, the keycap body 11*b* is made of a translucent material or a transparent material. That is, the top wall 111 and the lateral wall 112 of the keycap body 11*b* are made of the translucent material or the transparent material. Moreover, the top wall 111 of the keycap body 11*b* is not equipped with the hollow region 1110 and the glass plate 1111 as shown in FIG. 1. After the light beams L from the light-emitting elements 122 of the display module 12 are transmitted through the bottom surface 1212 of the light-transmissible circuit substrate 121, the top surface 1211 of the light-transmissible circuit substrate 121 and the top wall 111 of the keycap body 11*b* sequentially, the light beams L are outputted from the keycap body 11*b*.

Figure 5:
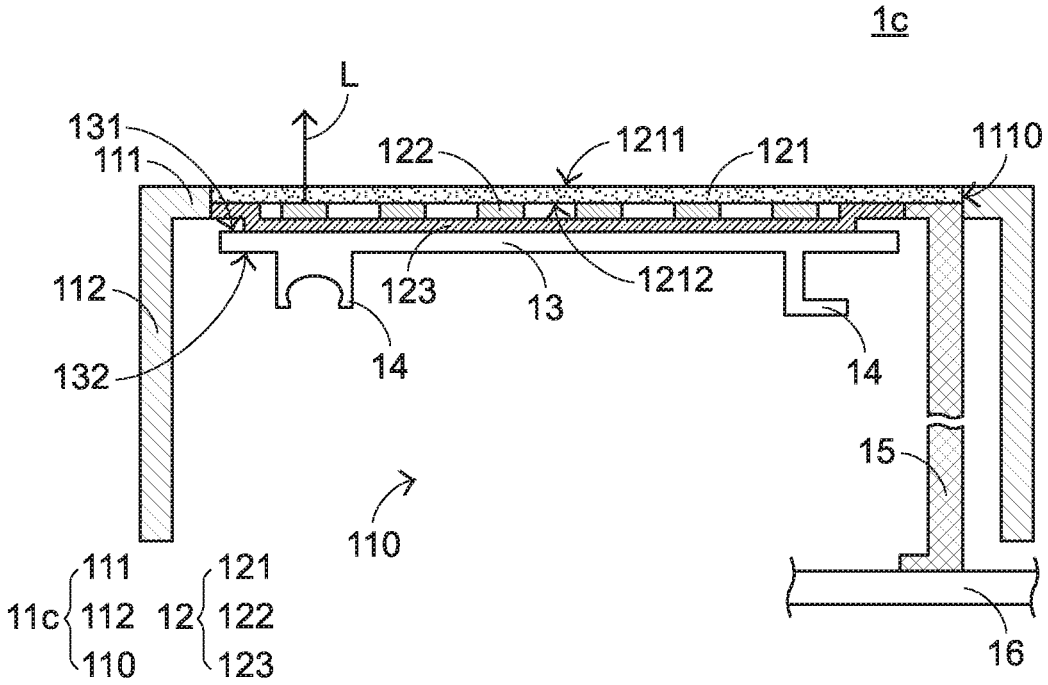
FIG. 5 is a schematic cross-sectional view illustrating a keycap structure according to a fourth embodiment of the present invention.

FIG. 5 is a schematic cross-sectional view illustrating a keycap structure according to a fourth embodiment of the present invention. In comparison with the keycap structure 1 of FIG. 1, the top wall 111 of the keycap structure 1*c* in this embodiment is distinguished. In this embodiment, the top wall 111 of the keycap structure 1*a* comprises the hollow region 1110 only. Moreover, the display module 12 is directly installed within the hollow region 1110 of the top wall 111. After the light beams L from the light-emitting elements 122 of the display module are transmitted through the bottom surface 1212 of the light-transmissible circuit substrate 121 and the top surface 1211 of the light-transmissible circuit substrate 121 sequentially, the light beams L are outputted from the keycap body 11*c*.

From the above descriptions, the present invention provides the keycap structure. The plural light-emitting elements of the display module are installed on the bottom surface of the light-transmissible circuit substrate. The bottom surface of the light-transmissible circuit substrate is located away from the top wall of the keycap body. The protective layer is located under the plural light-emitting elements to cover the plural light-emitting elements. Due to this structural design, the following benefits are achieved. While the keycap structure is pressed down by the user's finger, the pressing force on the display module is blocked by the light-transmissible circuit substrate and the protective layer. Since the light-emitting elements are not suffered from the direct impact by the pressing force, the possibility of causing damage of the light-emitting elements will be minimized and the capability of the display module to withstand the pressure of the user's finger will be effectively enhanced. Moreover, since these light-emitting elements are installed between the bottom surface of the light-transmissible circuit substrate and the protective layer, the moisture is blocked by the light-transmissible circuit substrate and the protective layer. Since the moisture does not readily enter the light-emitting elements, the possibility of causing the damage of the light-emitting elements by moisture will be minimized. When the keycap structure of the present invention is applied to various key structures, the light intensities, the light colors and the luminous zone changes of the display module can be adjusted according to the user's requirements. Consequently, the pattern shown on the keycap body can be designed by the user. Moreover, since the light-emitting elements of the display module are micro light-emitting diodes, the appearance of the key structure can meet the requirements of slimness and light weightiness.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. A keycap structure, comprising:

a keycap body comprising a top wall and a lateral wall, wherein the lateral wall is extended downwardly from a periphery region of the top wall, and an accommodation space is defined by the top wall and the lateral wall collaboratively; and a display module disposed within the accommodation space of the keycap body, and comprising a light-transmissible circuit substrate and plural light-emitting elements, wherein the light-transmissible circuit substrate has a top surface and a bottom surface opposed to the top surface, the top surface of the light-transmissible circuit substrate is located near the top wall of the keycap body, and the bottom surface of the light-transmissible circuit substrate is located away from the top wall of the keycap body, wherein the plural light-emitting elements are installed on the bottom surface of the light-transmissible circuit substrate and electrically connected with the light-transmissible circuit substrate, and the plural light-emitting elements emit light beams, wherein after the light beams are transmitted through the bottom surface, the top surface and the top wall sequentially, the light beams are outputted from the keycap body, wherein the light beams from the plural light-emitting elements are collaboratively formed as a luminous zone, and a pattern corresponding to the luminous zone is shown on the display module.

2. The keycap structure according to claim 1, wherein the top wall of the keycap body comprises a hollow region and a glass plate, and the glass plate is installed within the hollow region, wherein after the light beams from the plural light-emitting elements are transmitted through the bottom surface, the top surface and the glass plate of the top wall sequentially, the light beams are outputted from the keycap body.

3. The keycap structure according to claim 1, wherein the top wall of the keycap body comprises a hollow region, wherein after the light beams from the plural light-emitting elements are transmitted through the bottom surface, the top surface and the hollow region of the top wall sequentially, the light beams are outputted from the keycap body.

4. The keycap structure according to claim 1, wherein the keycap body is made of a translucent material or a transparent material.

5. The keycap structure according to claim 1, wherein the display module further comprises a protective layer, wherein the plural light-emitting elements and the bottom surface of the light-transmissible circuit substrate are covered by the protective layer, and the plural light-emitting elements are arranged between the light-transmissible circuit substrate and the protective layer.

6. The keycap structure according to claim 5, wherein the keycap structure further comprises a supporting pedestal, and the supporting pedestal is disposed within the accommodation space of the keycap body, wherein the display module is arranged between the top wall of the keycap body and the supporting pedestal, and the supporting pedestal has a first surface and a second surface opposed to the first surface, wherein the protective layer of the display module is contacted with the first surface of the supporting pedestal.

7. The keycap structure according to claim 6, wherein the keycap structure further comprises at least one coupling element, and the at least one coupling element is installed on the second surface of the supporting pedestal, wherein the at least one coupling element is connected with an ascending/descending member.

8. The keycap structure according to claim 7, wherein the at least one coupling element is integrally formed with the supporting pedestal.

9. The keycap structure according to claim 1, wherein the keycap structure further comprises a flexible circuit board, wherein the flexible circuit board is electrically connected to the light-transmissible circuit substrate, and the light-transmissible circuit substrate is electrically connected with an external driving control circuit board through the flexible circuit board.

10. The keycap structure according to claim 1, wherein the plural light-emitting elements are micro light-emitting diodes.

11. A keycap structure, comprising:

a keycap body comprising a top wall and a lateral wall, wherein the lateral wall is extended downwardly from a periphery region of the top wall, an accommodation space is defined by the top wall and the lateral wall collaboratively, and the top wall comprises a hollow region; and a display module disposed within the hollow region of the top wall, and comprising a light-transmissible circuit substrate and plural light-emitting elements, wherein the light-transmissible circuit substrate has a top surface and a bottom surface opposed to the top surface, the top surface of the light-transmissible circuit substrate is exposed outside the top wall of the keycap body, and the bottom surface of the light-transmissible circuit substrate faces the accommodation space of the keycap body, wherein the plural light-emitting elements are installed on the bottom surface of the light-transmissible circuit substrate and electrically connected with the light-transmissible circuit substrate, and the plural light-emitting elements emit light beams, wherein after the light beams are transmitted through the bottom surface and the top surface sequentially, the light beams are outputted from the keycap body, wherein the light beams from the plural light-emitting elements are collaboratively formed as a luminous zone, and a pattern corresponding to the luminous zone is shown on the display module.

* * * * *